US006417814B1

(12) United States Patent
Hupka et al.

(10) Patent No.: US 6,417,814 B1
(45) Date of Patent: Jul. 9, 2002

(54) REFLECTOR ANTENNA WITH A STATOR PORTION AND A ROTOR PORTION ROTATABLE RELATIVE TO THE STATOR

(75) Inventors: Rolf Hupka, Flintbek; Bernd Rümmeli, Strande, both of (DE)

(73) Assignee: RR Elektronische Geräte GmbH & Co. KG, Kiel (DE)

( * ) Notice: Subject to any disclaimer, the term of this patent is extended or adjusted under 35 U.S.C. 154(b) by 0 days.

(21) Appl. No.: 09/704,226

(22) Filed: Nov. 1, 2000

(Under 37 CFR 1.47)

(30) Foreign Application Priority Data

Nov. 2, 1999 (DE) ..... 199 52 817

(51) Int. Cl.[7] ..... H01Q 3/00
(52) U.S. Cl. ..... 343/757; 343/765; 343/766
(58) Field of Search ..... 343/757, 765, 343/766, 840, 872, 906, 882

(56) References Cited

U.S. PATENT DOCUMENTS

| | | | | |
|---|---|---|---|---|
| 5,432,524 A | * | 7/1995 | Sydor | 343/765 |
| 5,619,215 A | * | 4/1997 | Sydor | 343/766 |
| 6,188,367 B1 | * | 2/2001 | Morrison et al. | 343/765 |
| 6,198,452 B1 | * | 3/2001 | Beheler et al. | 343/757 |
| 6,262,688 B1 | * | 7/2001 | Kasahara | 343/766 |

* cited by examiner

*Primary Examiner*—Tan Ho
(74) *Attorney, Agent, or Firm*—Henry M. Feiereisen

(57) ABSTRACT

A reflector antenna is disclosed with a stator portion and a rotor portion which is supported for rotation relative to the stator portion about a rotation axis. A reflector that is connected by an electrical connection with the stator portion, is secured to the rotor portion. The electrical connection is formed as a flexible connecting cable, wherein one end of the cable is attached to the rotor portion and the other end is attached to the stator portion. A segment of the connecting cable rotates with half the rotation speed of the rotor portion and with the same rotation direction as the rotor portion.

52 Claims, 11 Drawing Sheets

REFLECTOR ANTENNA WITH A STATOR PORTION AND A ROTOR PORTION ROTATABLE RELATIVE TO THE STATOR

CROSS-REFERENCES TO RELATED APPLICATIONS

This application claims the priority of German Patent Application Serial No. 199 52 817.9, filed Nov. 2, 1999, the subject matter of which is incorporated herein by reference.

BACKGROUND OF THE INVENTION

The present invention relates to a reflector antenna with a stator portion and a rotor portion which is supported for rotation relative to the stator portion about a rotation axis, with a reflector secured to the rotor portion and connected by an electrical connection with the stator portion.

Reflector antennas of this type are used with increasing frequency on moveable vessels, such as ships, for receiving radio signals emitted by satellites. Until now, the electrical connection between the rotor portion and the stator portion has been unsatisfactory, since a fixed connecting cables could not be used between the rotor portion and the stator portion and the electrical antenna signals had to be transmitted instead from the rotor portion to the stator portion by using, for example slip rings. However, slip rings introduce noise in the transmission so that the transmitted signal tends not to be clear. Moreover, the wear of the slip rings strongly affects their performance as evidenced by an increase in the number of interfering signals. Arcing can also falsify the transmitted data, so that a clear reception can no longer be expected.

SUMMARY OF THE INVENTION

It is thus an object of the present invention to provide an improved reflector antenna, obviating the afore-stated drawbacks.

In particular, it is an object of the present invention to provide an improved a reflector antenna that can transmit radio signals received by the reflector to the stator portion with as little loss and as much clarity as possible.

These objects, and others which will become apparent hereinafter, are attained in accordance with the present invention by providing the connection as a flexible connecting cable, wherein one end of the cable is attached to the rotor portion and the other end is attached to the stator portion. The end attached to the rotor portion does not move relative to the rotor portion, and the end is attached to the stator portion does not move relative to the stator portion. The ends face one another in the direction of the rotation axis and are connected through a segment of the connecting cables, the respective segment rotating with half the rotation speed of the rotor portion with the same rotation direction as the rotor portion.

Since the end of the connecting cables that is connected in this manner to the stator portion is tracking, the rotor portion can be connected to the stator portion by a flexible connecting cables. This flexible cables can be implemented as a shielded cables, thereby reducing the losses produced in the connecting cables. Accordingly, the received antenna power available at the output of the reflector antenna is maximized and becomes available in high quality, for example, for providing signals to monitors.

According to an embodiment of the invention, the rotatable segment of the connecting cables passes through a first guide disposed on a drive wheel that is driven with half the rotation speed of the rotor portion. The rotatable segment of connecting cables is connected to the stator portion before the connecting cables enters the guide, and is connected with the rotor portion after the connecting cables leaves the guide. The connecting cables rotates in the guide with half the rotation speed of the rotor portion. In this way, the desired rotation speed can be precisely maintained, eliminating mechanical stress in the connecting cables.

According to another embodiment of the invention, the rotatable segment of the connecting cables is guided through a channel of the drive wheel from the center of the drive wheel outwardly towards the circumference of the drive wheel. This arrangement of the drive channel not only reliably guides the rotatable segment of the connecting cables, but also guides the rotatable segment from the stator portion to the rotor portion with a curvature in conformance with design constraints.

According to another embodiment of the invention, the channel is formed as a bore which surrounds the rotatable segment of the connecting cables with ample clearance so that the connecting cables is movably supported in the bore. In this way, the rotatable segment of the connecting cables is not prevented from performing the necessary compensating motion in order to track the respective rotation of the rotor portion.

According to another embodiment of the invention, the rotatable segment of the connecting cables extends through a slot in the form of a channel that surrounds the connecting cables with ample clearance. The slot extends radially through the drive wheel. Such slot can be easily produced and can reliably guide the connecting cables.

According to another embodiment of the invention, the connecting cables includes another section that continuous from the rotatable segment in the direction of the rotor portion and passes through a guide tube. This section that extends into guide tube rotates with the rotor portion with the same rotation direction and the same rotation speed. The guide tube is hence rotatably coupled with the rotating portion. This produces a particularly space-saving arrangement of the connecting cables.

According to another embodiment of the invention, drive means are provided on the drive wheel for driving the rotor portion that rotates with twice the rotation speed of the drive wheel. In this way, the rotation speed of the rotor portion relative to that of the drive wheel can easily controlled without having to resort to complex drive assemblies.

According to another embodiment of the invention, the drive means are formed as a shaft that extends through the drive wheel parallel to the shaft of the drive wheel. Drive pinions mesh with teeth disposed on respective ends of the shaft that project from opposing surfaces of the drive wheel. The teeth are connected, on one hand, with the stator portion and, on the other hand, by another pinion with the rotor portion. The drive pinions increase the rotation speed by a ratio of 2:1 relative to the drive wheel. A shaft of this type which extends through the drive wheel with at least one pinion and a deflection pinion for reversing the rotation direction, represents a simple and therefore inexpensive gear that can maintain the ratio of the rotation speed of the rotor portion to the rotation speed of the connecting cables at a value of 2:1. By directly coupling the rotor portion to the drive wheel, the rotation speed ratio is held constant in each phase independent of the rotation speed of the drive wheel. The necessary drive means are inexpensive and can be easily assembled.

According to another embodiment of the invention, the rotor portion has a first motor that drives the rotor portion relative to the drive wheel. In addition, the drive wheel is driven by a second motor located on the stator portion. With the separate motor drive, the rotor portion and the drive wheel can be driven independently of one another, so that the drive wheel has exactly half the rotation speed of the rotor portion. Moreover, the motors can be easily electrically controlled, thereby eliminating complicated and expensive mechanical controls.

According to another embodiment of the invention, the two motors are coupled by suitable gears to the rotor portion and the drive wheel, respectively, with the rotor portion being controlled relative to the drive wheel with a ratio of 2:1. Such gears are simple and can be manufactured relatively inexpensively. The rotation speed of the rotor portion can be selected to be exactly half the rotation speed of the drive wheel.

According to another embodiment of the invention, the two motors are coupled to the drive wheel and the rotor portion, respectively, by toothed belts. Toothed gear drives of this type are particularly simple and easy to maintain. They can also be quickly exchanged and allow precise control of the drive wheel relative to the rotor portion.

According to another embodiment of the invention, both sides of the toothed belts have teeth, wherein the teeth on one side mesh with the teeth of a drive pinion and the teeth on the other side mesh with the teeth of the rotor portion. By suitably sizing the teeth disposed on the respective toothed belts, a single toothed belt is sufficient to drive the rotor portion in the same rotation direction as the drive wheel with twice the rotation speed.

According to another embodiment of the invention, the toothed belt engages with the teeth of the rotor portion and after one turn, engages with the teeth of the drive wheel. In this way, two different drive means, i.e., the drive wheel and the rotor portion, respectively, can be driven by deflecting the toothed belt.

According to another embodiment of the invention, the stator portion as well as the rotor portion include a section formed as a hollow cylinder. Teeth are disposed on the outer surface of the hollow cylinder, whereas the center segment is supported on the inner surface of the hollow cylinder. The drive wheel is supported for rotation relative to the hollow cylinder, so that the two hollow cylinders and the drive wheel form a simple gear which transforms the rotation speeds as desired.

The connection of the reflector antenna with the hollow cylinder of the rotor portion embodies an advantageous drive for the reflector antenna. A corresponding drive can be used for controlling two antenna movements in the vertical plane, wherein electrical power is supplied by a wire of the connecting cables.

According to another embodiment of the invention, after the connecting cables exits the channel, the cables s guided to an attachment point of the rotor portion through a tube connected to the drive wheel. The connecting cables is guided in this tube with ample clearance so as to be able to perform a compensating motion conforming to the respective antenna motion.

According to another embodiment of the invention, the tube is bent in the shape of a gallows that is curved from the exit of the channel of the drive wheel towards a rotation point formed on the rotor portion. The connecting cables passes through the rotation point and extends towards a connecting point formed on the rotor portion, with the ends of the connecting cables being connected to the connecting point. The gallows-like shape precisely guides the connecting cables by preventing the cables from leaving a predetermined passageway when the rotor portion rotates. This ensures that the antenna is guided accurately and without error.

According to another embodiment of the invention, the tube is bent in the shape of a gallows that is curved from the exit of the channel of the drive wheel towards an attachment point formed in a guide tube connected with the rotor portion. A strand of the connecting cables that exits from the gallows-shaped tube is guided into the guide tube towards the rotor portion. The guide tube allows the attachment point to be moved to a particularly advantageous location which is preferably located on the rotation axis. This enables simple and space-saving guiding of the connecting cables.

According to another embodiment of the invention, the attachment point of the stator portion is formed as an apex of a dome which is rigidly connected with the stator portion. The connecting cables extends along the walls of the dome from the attachment point to a connecting point. This guide arrangement for the connecting cables is particularly suited for a reflector antenna that is covered by a dome. Guiding the connecting cables along the wall of the dome represents a simple and cost-effective mechanical solution.

According to another embodiment of the invention, the cross-section of the tube is suitable for receiving at least one connecting cables. In this way, the tube can guide several connecting cables between the rotor portion and the stator portion without causing interference between the various connecting cables due to the rotation of the rotor. Likewise, shielded cables that can include an electric power cables for supplying power to the drive can be commonly guided between the rotor portion and the stator portion.

According to another embodiment of the invention, the tube is at least partially formed as a flexible spiral wherein the connecting cables can be guided through the unobstructed cross-section of the spiral. In this way, the tube can be easily adapted to the prevailing conditions between the rotor portion and the stator portion.

According to another embodiment of the invention, the motors can be controlled by a controller, with control signals for a respective vertical and horizontal control of the antenna drives being produced by a comparator circuit. The comparator circuit makes it possible to orient the reflector antenna in a direction where received power optimal.

According to another embodiment of the invention, horizontal and vertical control signals can be produced by a deviation from the largest possible receivable signal. The reflector antenna will thereby always attempt to move to a region of a highest possible received antenna power.

According to another embodiment of the invention, eight control signals can be generated for controlling to a motor that control's antenna movements in the perpendicular and horizontal direction, wherein the control signal is produced by changes in the received power of the antenna depending on a ship's motion. In this way, the motor that control the antenna movement in the vertical direction is influenced so as to maintain the reflector antenna always at the most advantageous angular position, where the reflector antenna receives an optimal antenna power, independent of the instantaneous ship movement. This allows for the compensation of the ship's movement.

BRIEF DESCRIPTION OF THE DRAWING

The above and other objects, features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
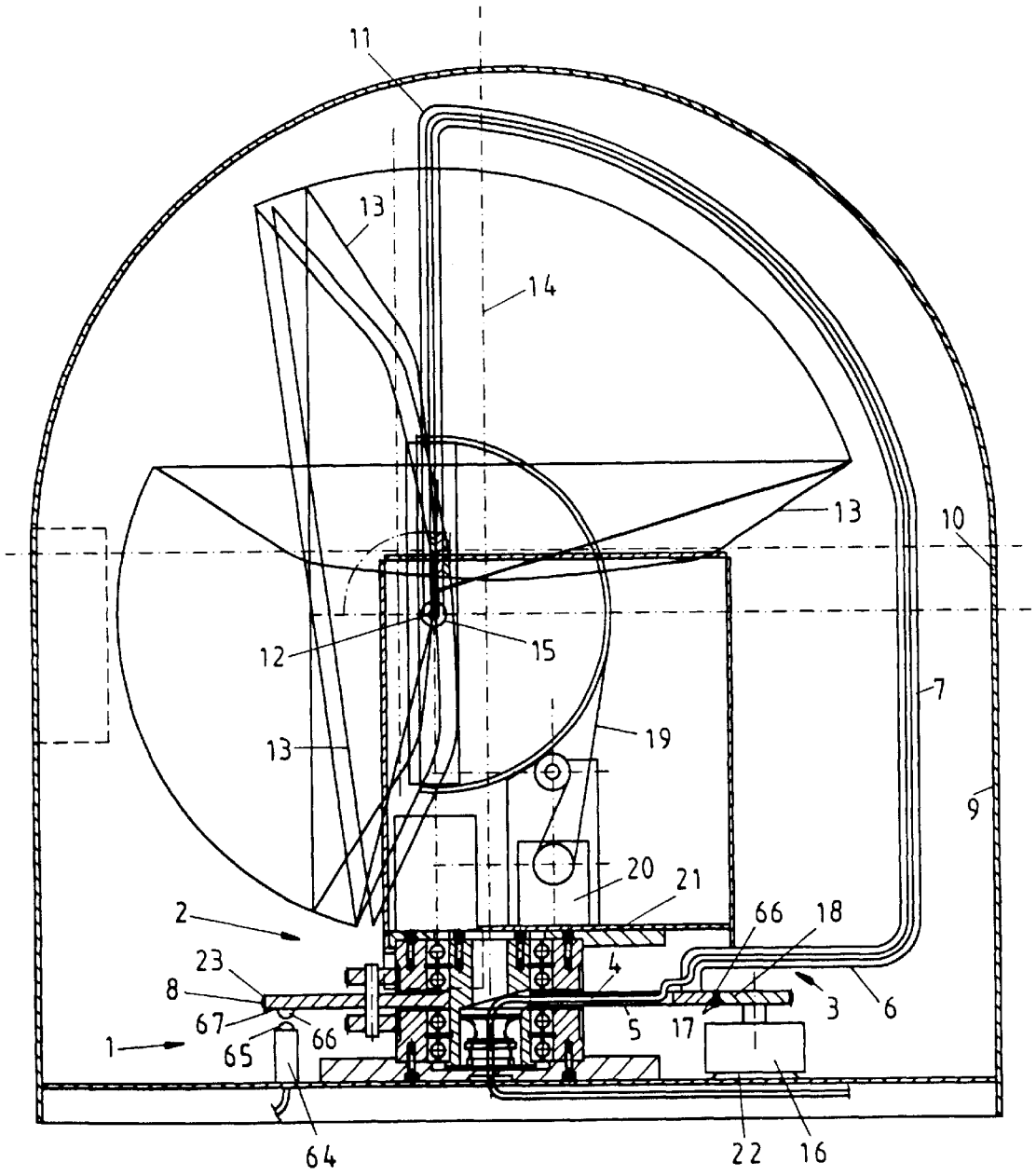
FIG. 1 is a side view of an orientatable antenna.

Turning now to the drawing, and in particular to FIG. 1, there is shown a connection 3 provided between a stator portion 1 and a rotor portion 2 of an orientatable antenna, with connecting cables 4, 5 extending through the connection 3. The connecting cables 4, 5 can be guided in a tube 6 that has the shape of a gallows 7 and extends from a drive wheel 8 parallel to an interior wall 9 of a dome 10 to an apex 11. From there, the connecting cables 4, 5 which may or may not be jacketed, extend to a receiving element 12 of a reflector antenna 13. The reflector antenna 13 is rotatably supported inside the dome (Radome) 10 for rotation about a vertical axis 14 and a horizontal axis 15. The reflector antenna 13 is rotated about in the vertical axis 14 by a motor 16 that is connected to a driven shaft 17 by a pinion 18 driving a drive wheel 8. The reflector antenna 13 is rotated about the horizontal axis 15 by a belt drive 19 that is driven by a motor 20.

The motor 20 is fixedly connected to the rotor portion 2 by a cover plate 21 and rotates with the cover plate 21. Conversely, the motor 16 is fixedly connected to the stator portion 1 by a foundation 22, so that the pinion 18 that meshes with the teeth 23 of the drive wheel 8 rotates the drive wheel 8 about the vertical axis 14 when the motor 16 is switched on.

Figure 2:
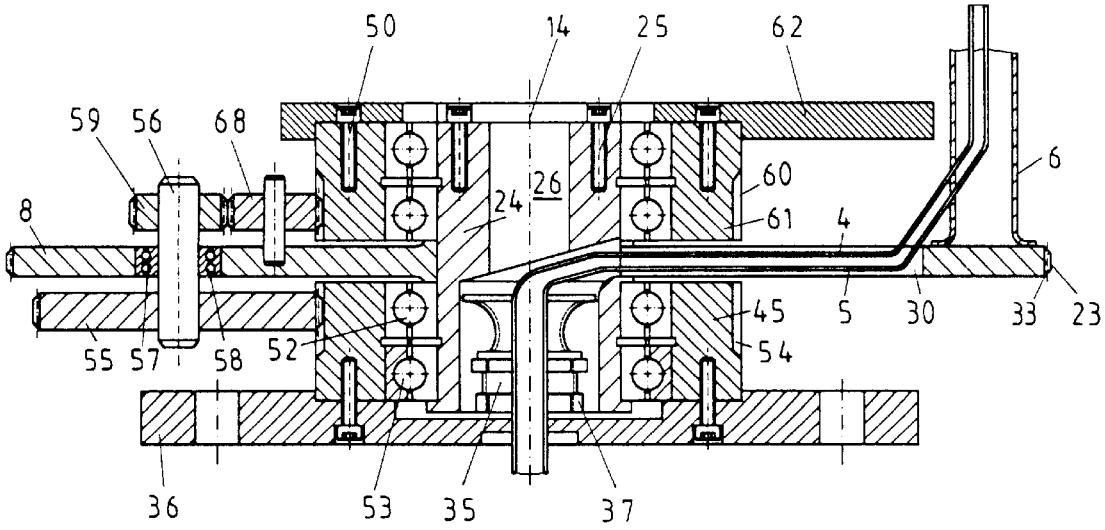
FIG. 2 is an enlarged diagram of a gear driving the orientatable antenna.
Figure 3:
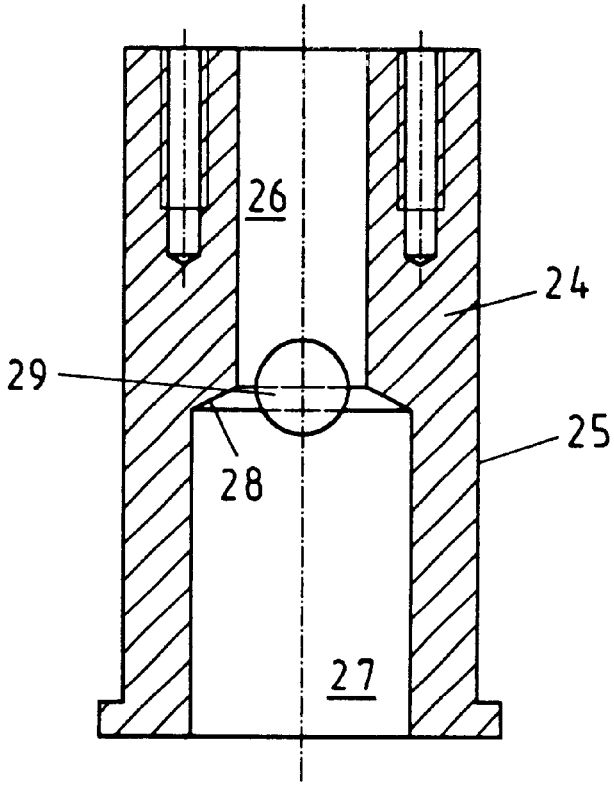
FIG. 3 is a longitudinal section through a center segment along the line III—III of FIG. 4.
Figure 4:
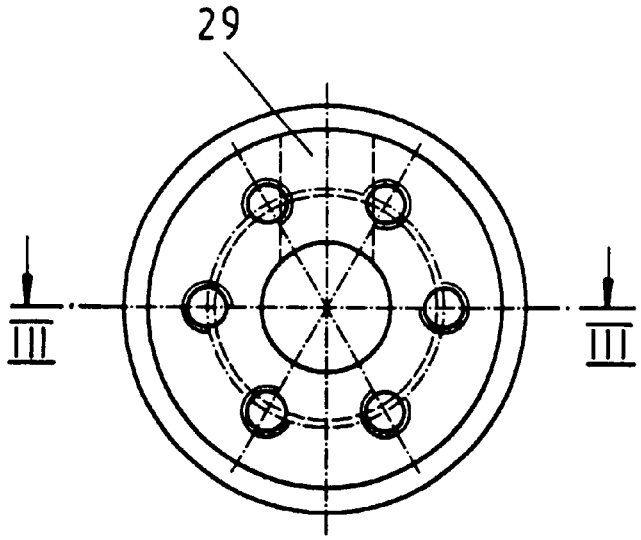
FIG. 4 is a top view of a center segment.
Figure 6:
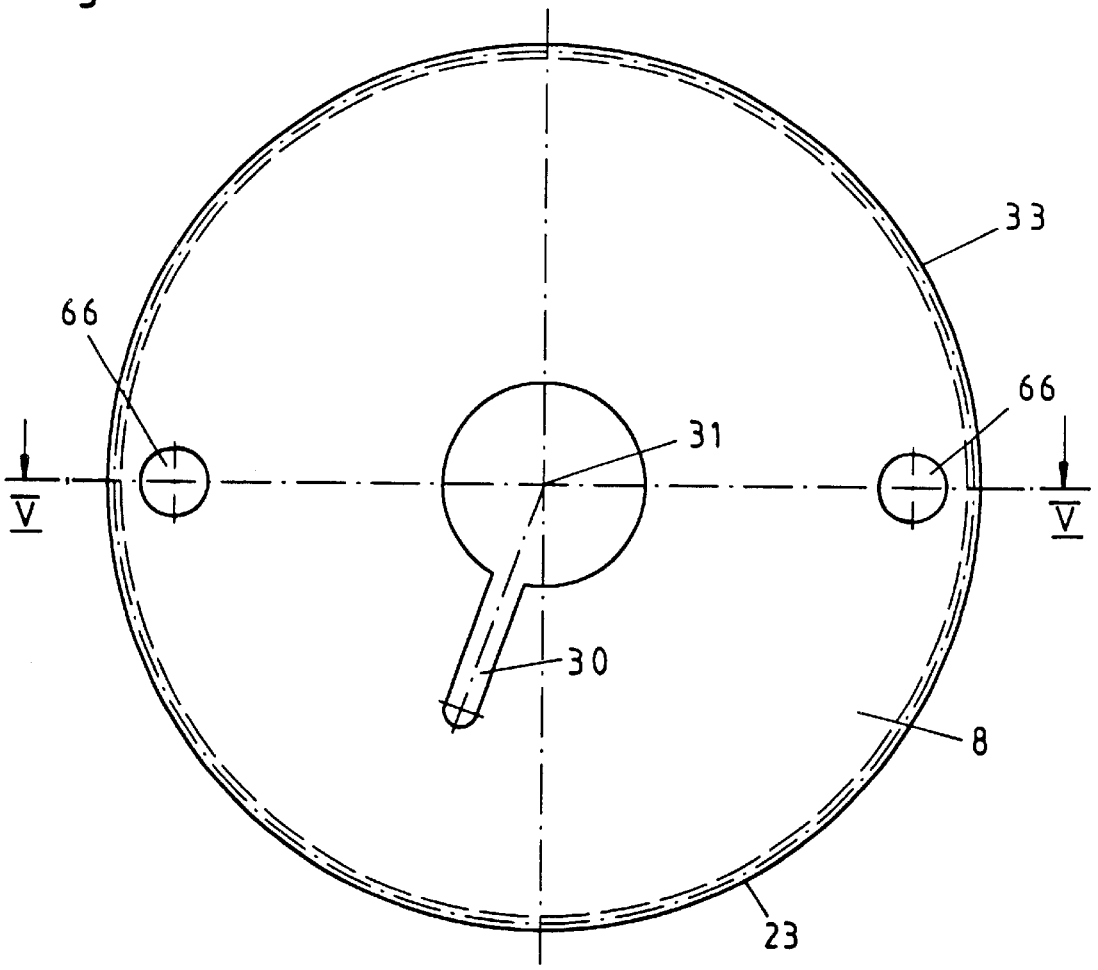
FIG. 6 is a top view of the drive wheel.
Figure 8:
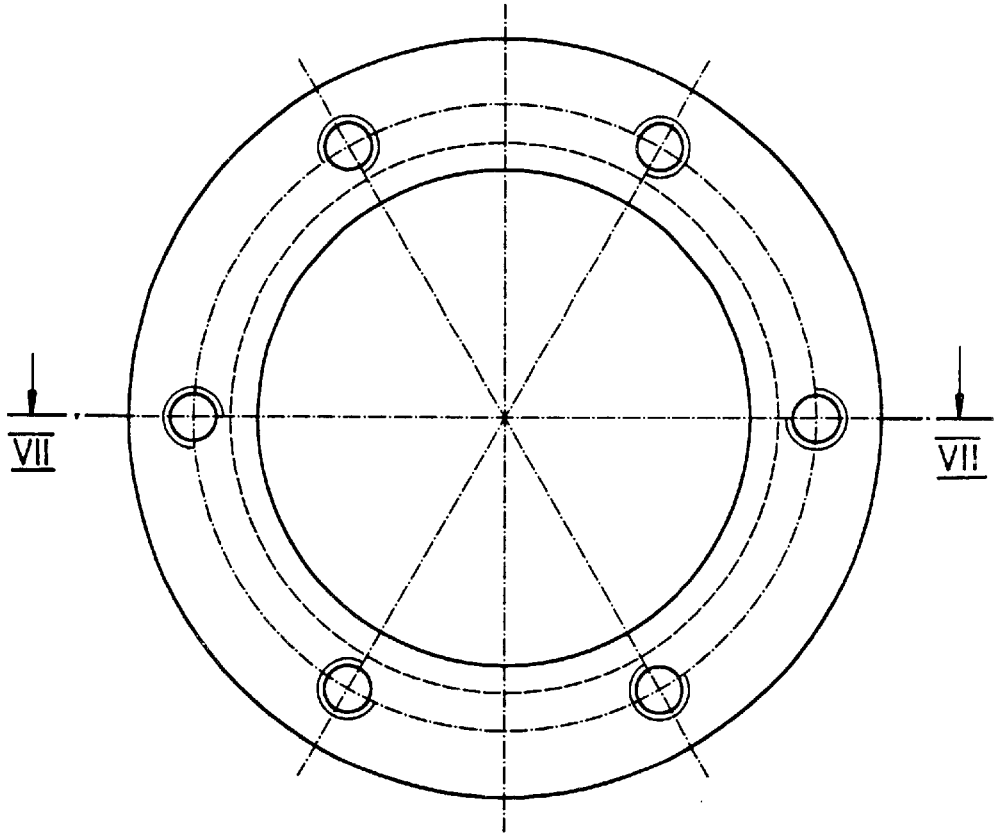
FIG. 8 is a top view of the hollow cylinder.
Figure 7:
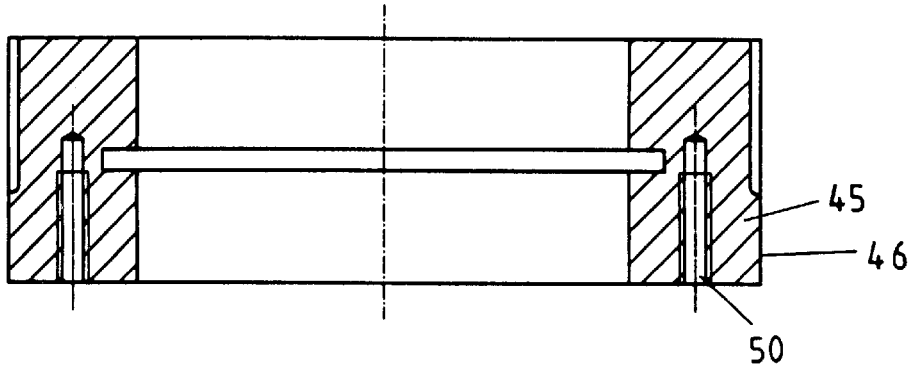
FIG. 7 is a cross-section through a hollow cylinder along the line VII—VII of FIG. 8.
Figure 10:
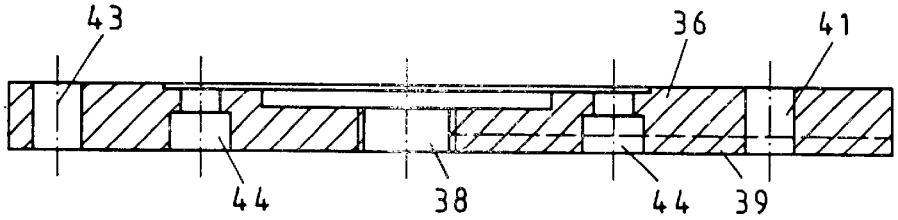
FIG. 10 is a cross-section through the base plate along the line X—X of FIG. 9.

Referring now to FIGS. 2 to 4, the drive wheel 8 is fixedly connected by a screw connection to a center segment 24 located on the cylindrical outer wall 25. The center segment 24 is penetrated by a center bore 26 that has a narrower cross section in the upper portion facing the rotor portion 2 than the adjacent lower portion 27. The lower portion of the bore 27 includes a conical transition in the direction of the narrower upper portion of the center bore 26. A cross bore 29 is located in the region of the conical transition 28, with the cross bore 29 merging with a channel 30 disposed in the drive wheel 8. As seen in FIG. 6, the channel 30 extends in a horizontal direction from a center point 31 of the drive wheel 8 towards its circumference 33 which has teeth 23. The circumference 33 can also have a smooth surface, without teeth.

The center point 31 is surrounded by the bore 34 which has a pass fit with the outer wall 25 of the center segment 24 and is furthermore affixed by the ball under a spring force, so that the transverse bore 29 extends in the direction of the channel 30. With this arrangement, a connecting cables 4, 5 that is inserted in the lower portion 27 of the center bore 26, can hence be inserted in the channel 30 through the transverse bore 29 and exit the channel 30 in the direction of the tube 6 of gallows 7.

Figure 9:
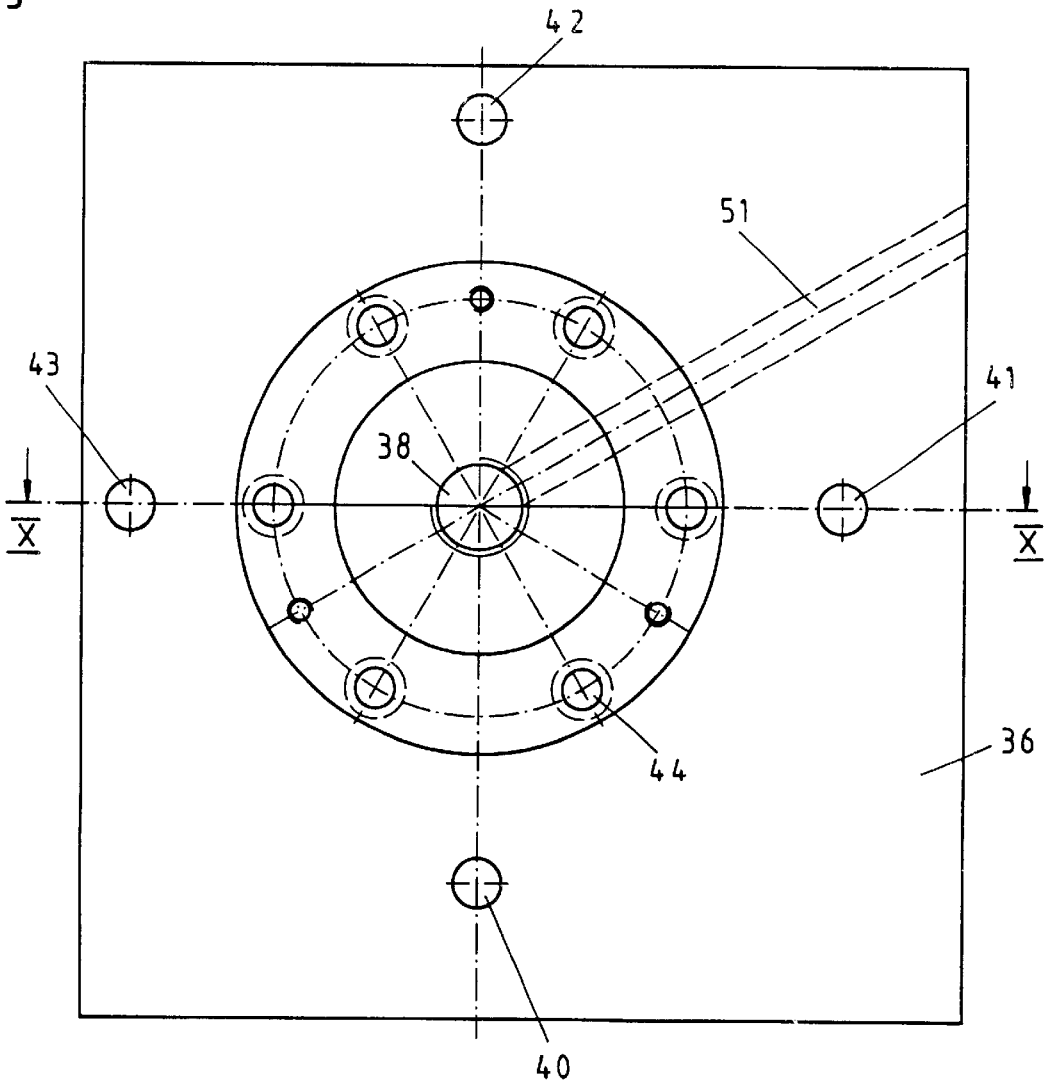
FIG. 9 is a top view of a base plate.
Figure 11:
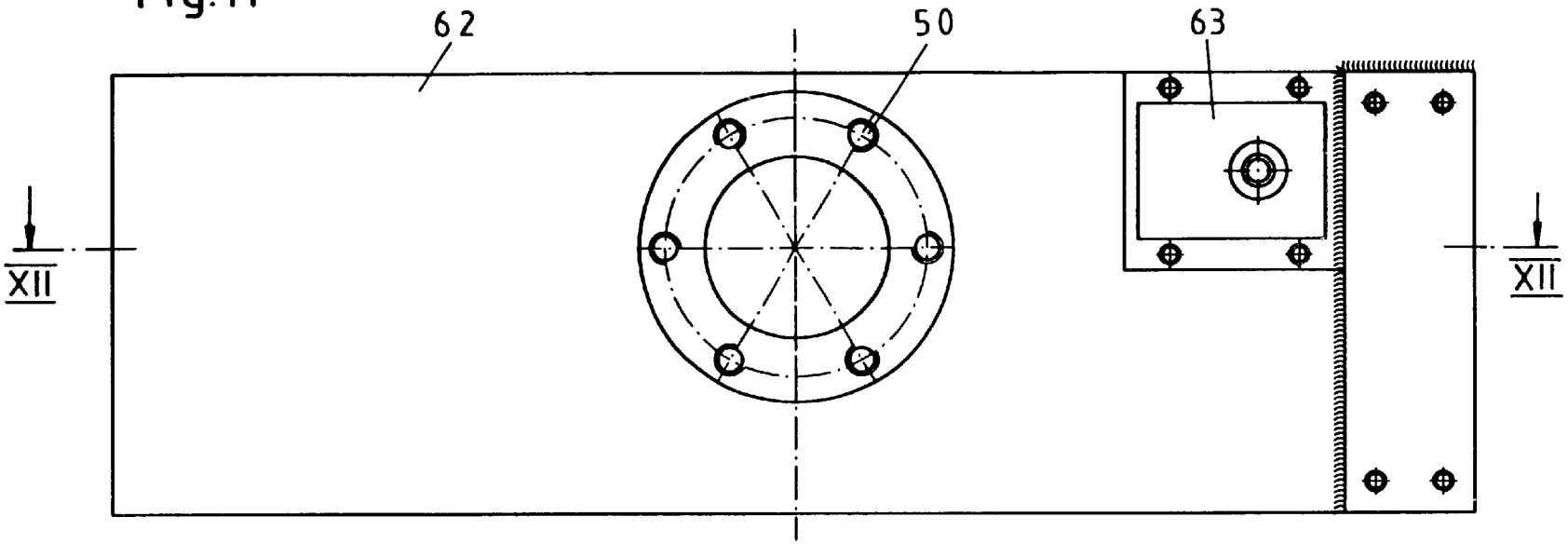
FIG. 11 is a top view of a cover plate.
Figure 12:
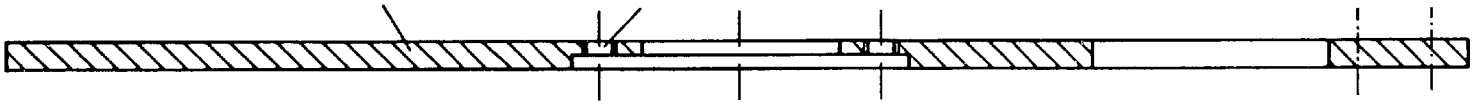
FIG. 12 is a cross-section through the cover plate along the line XII—XII of FIG. 11.

A cables feedthrough 35 is attached in the lower portion 27 of the center bore 26 and screwed with a nut 37 to a base plate 36 that forms the stator portion 1. The cables feedthrough 35 cooperates with a bore 38 disposed in the base plate 36, with the connecting cables 4, 5 being guided from the center bore 26 to a bottom side 39 of the base plate facing away from the center bore 26. As seen in FIG. 9, the base plate 36 is secured to the ground by bolts (not shown) extending through four screw holes 40, 41, 42, 43. In addition, the bore 38 is surrounded by a ring having six holes 44, with screws (not shown) extending therethrough into a hollow cylinder 45 that is connected with the base plate 36. As seen in FIG. 11, the hollow cylinder 45 is provided with corresponding threaded holes 50, into which the screws (not shown) extending through the holes 44 are screwed. A guide 51 adapted to receive the connecting cables 4, 5 exiting from the bore 38 extends on the bottom side 39 of the base plate 36.

The center segment 24 that is driven by the drive wheel 8 is rotatably supported by roller bearings 52, 53 relative to the hollow cylinder 45 that is rigidly connected with the base plate 36. The cylindrical surface 46 of the hollow cylinder 45 has teeth 54. A pinion 55 that is fixedly connected to a shaft 56 extending parallel to the vertical axis 14 meshes with the teeth 54. The shaft 56 extends through the drive wheel 8 and rotates with the drive wheel 8 about the perpendicular axis 14. This arrangement rotates the pinion 55 and the shaft 56 that is rigidly connected to the pinion 55. The shaft 56 is supported in the drive wheel 8 by roller bearings 57, 58.

The upper end of the shaft 56 that projects from the drive wheel 8, carries an upper pinion 59 that meshes with a deflection pinion 68. This deflection pinion 68 is supported on a axle that extends parallel to the shaft 56 so as to mesh with teeth 16 formed on an upper cylinder 61. The upper cylinder 61 is formed identically to the hollow cylinder. Like the hollow cylinder, the upper cylinder 61 includes threaded bores 50 for connection to a cover plate 62 via screws (not shown). A foundation 63 for the motor 20 is formed on the cover plate 62, with the drive belt 19 of the motor 20 providing the tilt motion of the reflector antenna 13 about the horizontal axis 15.

The gearing of the pinions 55, 59, 68 and the hollow cylinder 45, 61 is sized so that the cover plate 62 and the cylinder 61 that is fixedly connected with the cover plate 62, which together form the rotor portion 2, rotate with twice the rotation speed as the drive wheel 8. In this way, the tube 6 that is fixedly connected to the drive wheel 8 rotates with half the rotation speed of the rotor portion 2. This arrangement prevents the connecting cables 4, 5 inside the tube 6 from becoming untwisted.

To adjust the orientation of a reflector antenna 13 relative to a radiation source (not shown), the two motors 16, 20 have to be switched on. By switching on the motor 16, the rotor portion 2 rotates about the vertical axis 16 until the reflector antenna 13 is oriented in the direction of the radiation source. The pinion 18 initiates the rotation of the drive wheel 8. The tube 6 and the connecting cables 4, 5 extending therein also rotate with the drive wheel 8. The connecting cables 4, 5 rotate about a fixed point provided in the cables feedthrough 35 with the same rotation speed as the drive wheel 8. The shaft 56 and the corresponding axle of the pinion 68 also participate in the rotation. Both the shaft 56 and the drive wheel 8 are rotated by the pinion 55 moving on the rotating toothed gear 54. The rotation is also communicated to the two pinions 59, 68 which then rotate the upper cylinder 61. The rotation direction of the deflection pinion 68 is identical to that of the drive wheel 8. However, the rotation speed of the deflection pinion 68 is twice that of the drive wheel 8. The reflector antenna 13 that is fixedly connected to the cover plate 21 has therefore the same rotation direction as the shaft 56.

Figure 17:
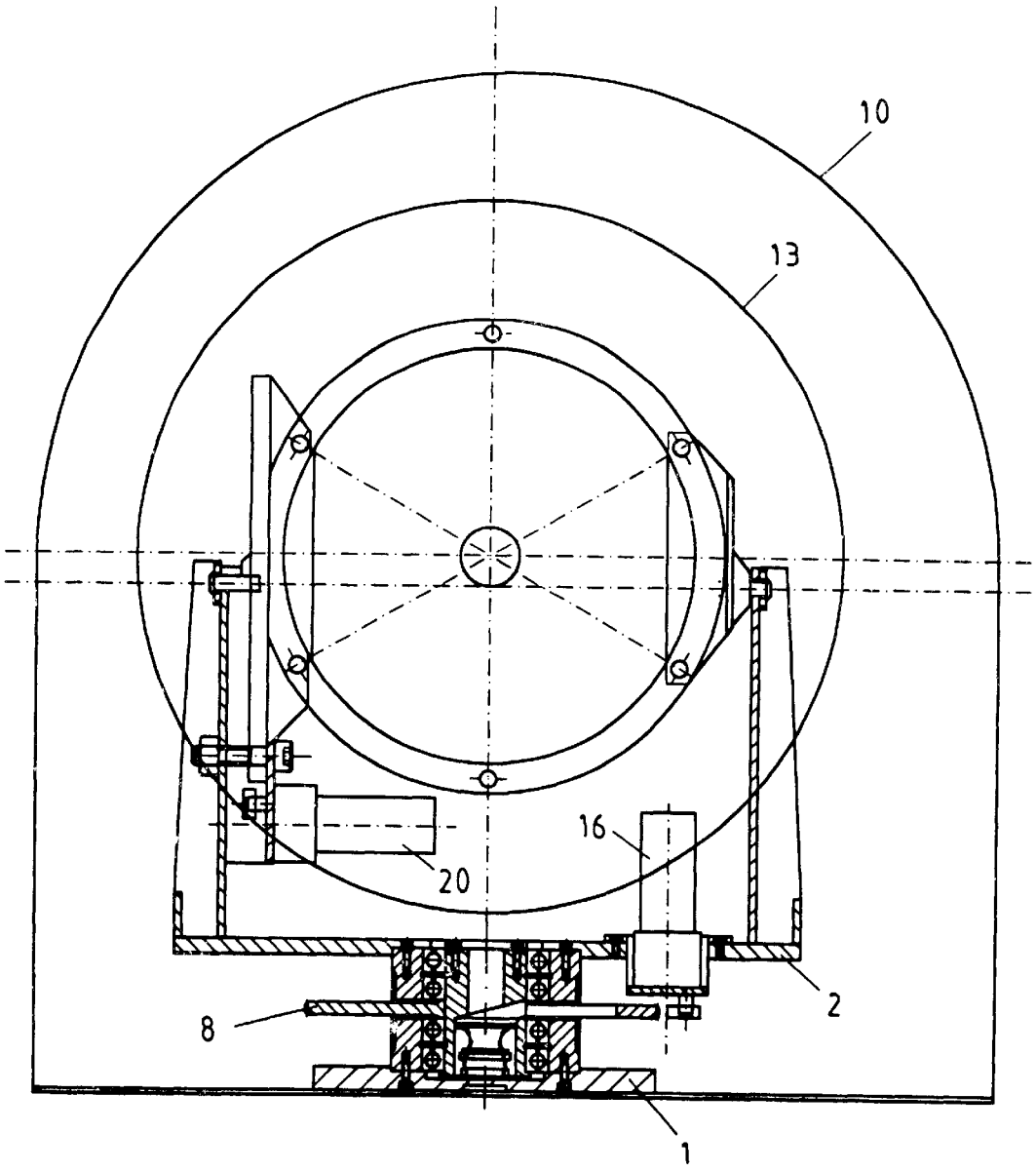
FIG. 17 is a side view of an orientatable reflector antenna.

The drive wheel can also be driven by a toothed belt that is guided on the circumference 33 of the drive wheel 8 which may or may not have teeth. The toothed belt encircles not only the circumference 33, but also the pinion 18, thereby transmitting the rotation of the pinion 18 to the drive wheel 8. According to the embodiment depicted in FIG. 17, the motor 16 can also be attached to the rotor portion 2, so that the motor 16, when switched on, rotates with the rotation speed of the rotor portion 2 and thereby moves the toothed belt encircling the drive wheel 8.

Figure 13:
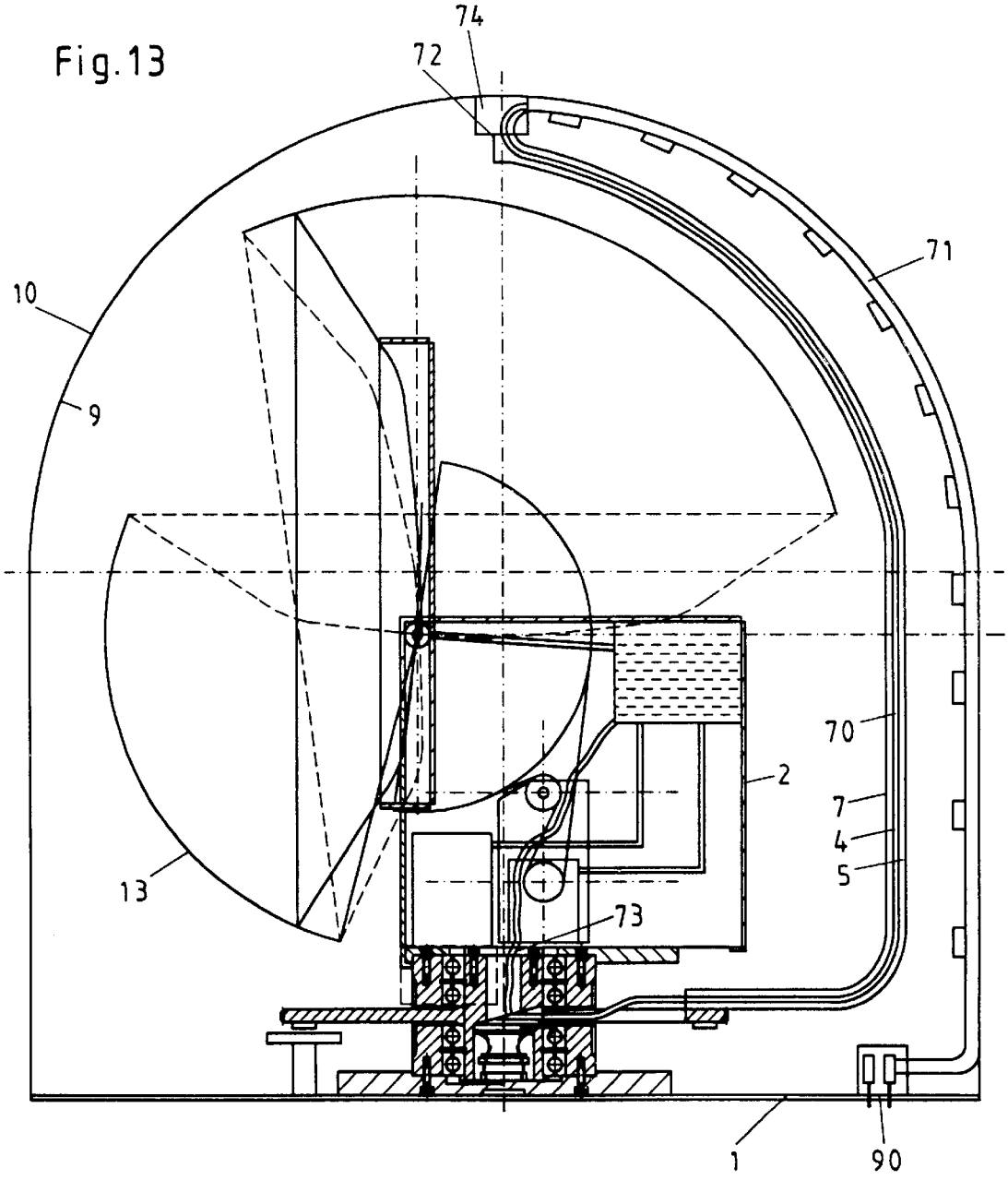
FIG. 13 is a side view of another embodiment of an orientatable antenna.
Figure 14:
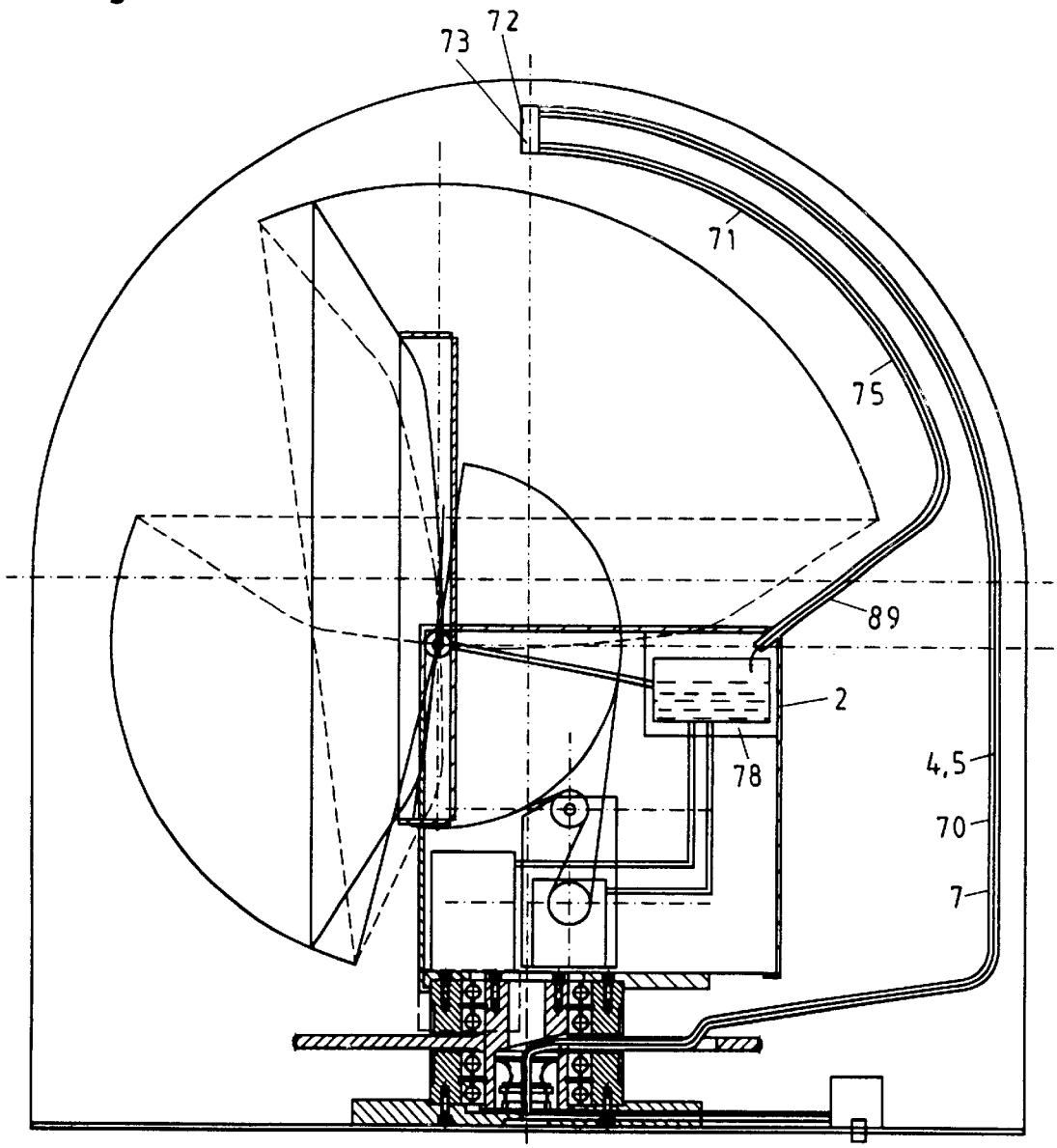
FIG. 14 is a side view of another embodiment of an orientatable antenna.
Figure 15:
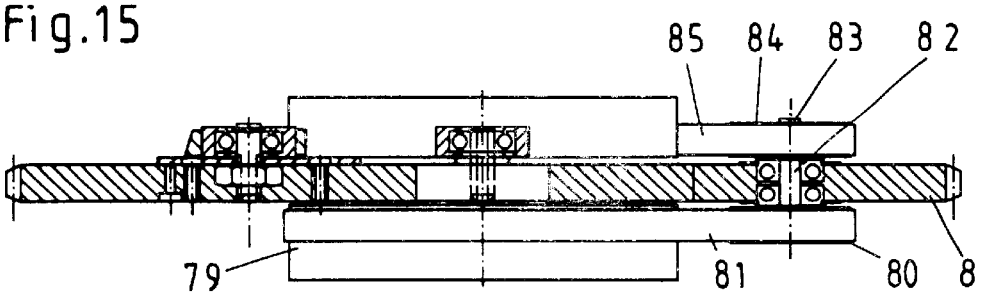
FIG. 15 is a top view of a drive wheel with a toothed belt.
Figure 16:
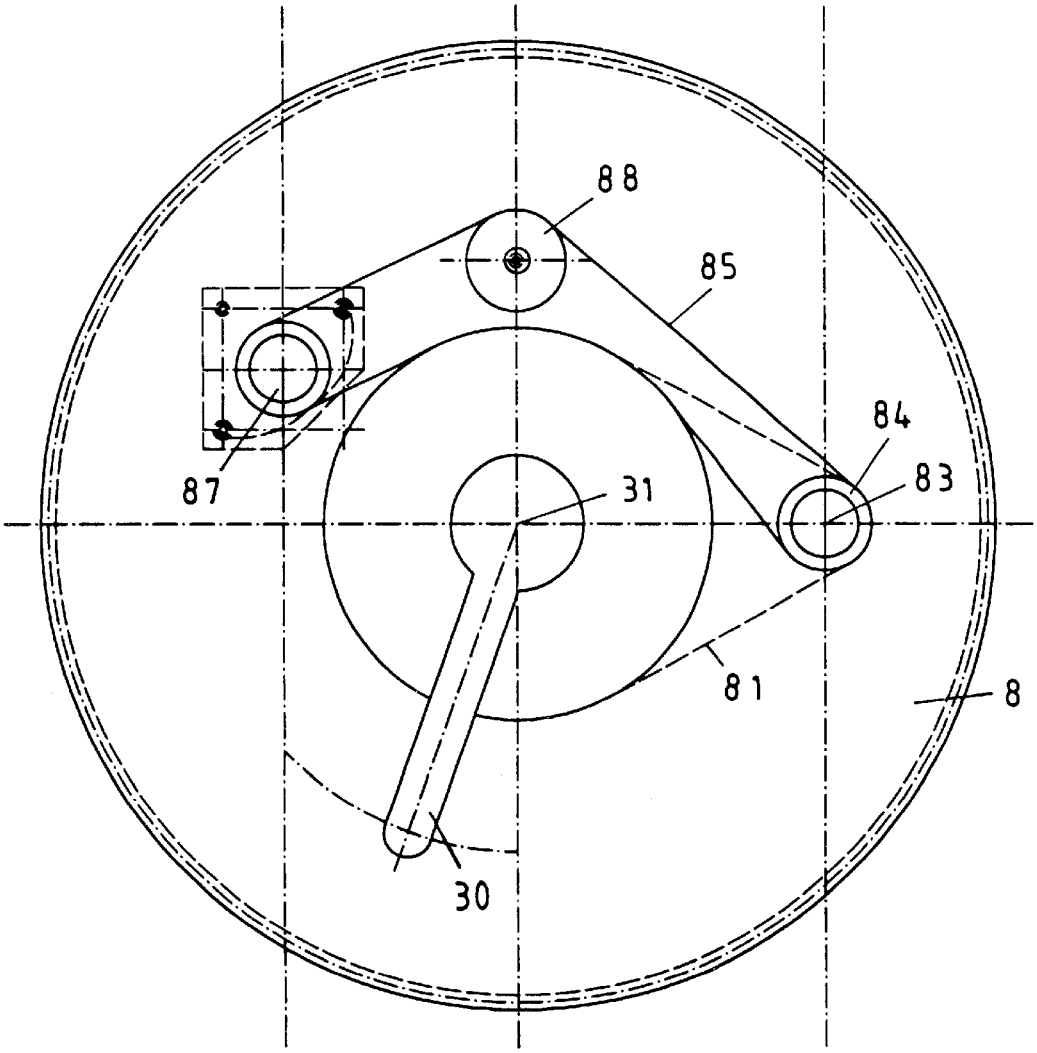
FIG. 16 is a cross-section through a drive wheel along the line XVI—XVI of FIG. 15.

The following connecting cable 4, 5 can not only transmit the antenna voltage received from the antenna element 12, but can also supply electric power to the motor 20 and optionally also to the motor 16. The power return line for the motor 20 and optionally also for the motor 16 can be provided along the gallows 7. In addition, as illustrated in FIG. 13, the return line can also be placed on the inner wall 9 of the dome 10. In this case, the transition from the stator portion 1 to the strand 70 of the connecting cables 4, 5 that rotate with half the rotation speed of the rotor portion 2 is located in the fixed apex 72 of the dome 10. This also serves as the attachment point 74 of the stator portion 1. A second strand 71 of the connecting cables 4, 5 extends from this attachment point 74 to a connecting point 90 where the received antenna power exits the dome 10.

Moreover, the transition between the strand 70 of the connecting cables 4, 5 that rotates with half the rotation speed of the rotor portion 2 and the rotor portion 2 can also be provided in the fixed apex 72 in the region of the attachment point 73. For this purpose, a strand 71 of the connecting cables 4, 5 that extends through a guide to 75, extends from this attachment point 73 in the direction of the rotor portion 2. The guide tube 75 is angled in the direction of the rotor portion 2 and merges with a connecting piece. 89 disposed in a switch box 78 that provides electrical connections for the reflector antenna 13 and the motors 16, 20.

Figure 5:
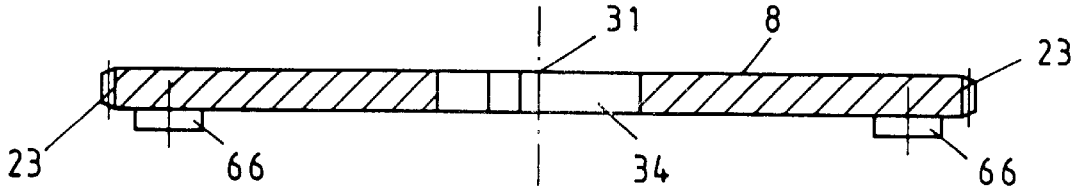
FIG. 5 is a cross-section through a drive wheel along the line V—V of FIG. 6.

The motors 16, 20 are controlled in response to the signal power received by the reflector antenna 13. As seen in FIGS. 5 and 6, a sensor 64 is employed for initially orienting the reflector 13 in relation to the respective travel direction of the vehicle as referenced, for example, to a North-South direction. A proximity electrode 65 of the sensor 64 projects in the direction of two pulse generators 66 that are formed with an offset of 180 degrees on a bottom side 67 of the drive wheel 8 and face the sensor 64.

For example, if a change in the orientation of the stator portion 1 relative to the source power received by the reflector antenna 13 is detected, then the decrease in the power received by the reflector antenna 13 can indicate the number of degrees the reflector antenna 13 has deviated from the direction of optimal reception of the source of radiation. The so determined angle is used to adjust the electric power of at least one of the two motors 16, 20 by an amount corresponding to the number of pulses for the determined angle. A corresponding number of pulse generators 66 is passed by the proximity electrode 65, thereby returning the reflector antenna 13 to a direction optimized for receiving the radiation from the source.

Likewise, if the reflector antenna 13 is installed on a vehicle, for example a ship, then the course change of the ship can be used to adjust the reflector antenna 13 with the help of the motor 16 to an optimal reception of the radiation emitted by the radiation source. Moreover, the ship's motion about its horizontal axis can be compensated by tracking the reflector antenna 13 about the horizontal axis 15. The motor 20 is controlled accordingly.

While the invention has been illustrated and described as embodied in a reflector antenna with a stator portion and a rotor portion rotatable relative to the stator, it is not intended to be limited to the details shown since various modifications and structural changes may be made without departing in any way from the spirit of the present invention.

What is claimed as new and desired to be protected by Letters Patent is set forth in the appended claims:

1. A reflector antenna, comprising:

a stator portion;

a rotor portion supported for rotation relative to the stator portion about at least one rotation axis;

a reflector secured to the rotor portion; and an electrical connection for connecting the rotor portion with the stator portion, said electrical connection formed as a flexible connecting cable, with a first end of the connecting cable being attached to the rotor portion and immovable relative to the rotor portion, and a second end of the connecting cable being attached to the stator portion and immovable relative to the stator portion, wherein the first end and the second end face one another in the direction of a vertical rotation axis, with the first end and second end being connected by a rotatable segment of the connecting cable that is capable of rotating in a rotation direction identical to a rotation direction of the rotor portion with a rotation speed that is half of a rotation speed of the rotor portion.

2. The reflector antenna according to claim 1, and further comprising a drive wheel that has a first guide and is driven with half the rotation speed of the rotor portion, wherein the rotatable segment of the connecting cables passes through the first guide, and wherein the connecting cable is connected to the stator portion before entering the first guide and is connected with the rotor portion after exiting the first guide.

3. The reflector antenna according to claim 2, wherein the first guide is a channel extending from a center of the drive wheel outwardly towards a circumference of the drive wheel.

4. The reflector antenna according to claim 3, wherein the channel is formed as a bore which surrounds the rotatable segment with enough clearance so that the connecting cable is movably supported in the bore.

5. The reflector antenna according to claim 3, wherein the drive wheel is rigidly connected with a center portion that is rotatably supported for rotation relative to both the stator portion and the rotor portion and includes a center bore extending therethrough, and further including a mounting sleeve surrounded by the center bore, with the connecting cable that passes through the stator portion projecting into the center bore and being secured in the mounting sleeve, wherein the mounting sleeve is rigidly connected with the stator portion and deflected from the stator portion in the direction of the channel.

6. The reflector antenna according to claim 3, and further comprising a tube connected to the drive wheel, wherein the connecting cable, after exiting the channel, is guided to an attachment point of the rotor portion through the tube.

7. The reflector antenna according to claim 6, wherein the tube is bent in the shape of a gallows that is curved from an exit of the channel of the drive wheel towards a rotation point formed on the rotor portion, with the connecting cable passing through the rotation point and extending towards a connecting point formed on the rotor portion, with the ends of the connecting cable connected to the connecting point.

8. The reflector antenna according to claim 6, and further including a guide tube connected to the rotor portion, wherein the tube is bent in the shape of a gallows that is curved from an exit of the channel of the drive wheel towards an attachment point formed in the guide tube, with a strand of the connecting cable that exits from the gallows being guided in the guide tube towards the rotor portion.

9. The reflector antenna according to claim 8, wherein a section of the guide tube adjacent to the attachment point has a curvature that extends approximately parallel to that of the gallows and is connected to the rotor portion by a connecting element.

10. The reflector antenna according to claim 6, wherein the tube has a cross-section suitable for receiving at least one connecting cable.

11. The reflector antenna according to claim 3, and further including a tube connected to the drive wheel, wherein the connecting cable, after exiting the channel, is guided to an attachment point of the stator portion through the tube.

12. The reflector antenna according to claim 11, wherein the attachment point of the stator portion is formed as an apex of a dome which is rigidly connected with the stator portion, with the connecting cable extending along a walls of the dome from the attachment point to a connecting point.

13. The reflector antenna according to claim 2, wherein the first guide is a slot formed as a channel and extending in a radial direction, and wherein the rotatable segment extends through the slot which surrounds the rotatable segment with ample clearance.

14. The reflector antenna according to claim 2, and further comprising drive means disposed on the drive wheel for driving the rotor portion.

15. The reflector antenna according to claim 14, wherein the drive means are formed as a shaft extending through the drive wheel parallel to the vertical rotation axis of the rotor portion, and further including a plurality of drive pinions meshing with teeth disposed on respective ends of the shaft that protrude from opposing surfaces of the drive wheel and also including an additional pinion, wherein the teeth are connected to the stator portion and also by the additional pinion to the rotor portion, and wherein the drive pinions increase the rotation speed of the rotor portion relative to the drive wheel by a ratio 2:1, while converting the rotation direction of the rotor portion to the same rotation direction as that of the drive wheel.

16. The reflector antenna according to claim 15, wherein the drive means include two toothed belts having a common drive formed by the drive pinions supported in the drive wheel.

17. The reflector antenna according to claim 15, wherein the drive means include at least one toothed belt, with the at least one toothed belt encircling a toothless outer circumference of the drive wheel and engaging with a drive pinion.

18. The reflector antenna according to claim 17, and further comprising a motor, wherein the drive pinion is driven by the motor, with the drive pinion secured to a driven shaft of the motor.

19. The reflector antenna according to claim 18, wherein the motor is rigidly connected with the stator.

20. The reflector antenna according to claim 18, wherein the motor is rigidly connected with the rotor.

21. The reflector antenna according to claim 17, wherein the drive wheel includes a concentric gearing and wherein the toothed belt which drives the drive pinion engages with the gearing.

22. The reflector antenna according to claim 21, wherein the drive pinion is secured to the shaft that extends through the drive wheel, and further including a driven pinion secured to an end of the shaft.

23. The reflector antenna according to claim 22, wherein a toothed belt having a respective set of teeth disposed on each side of the toothed belt is guided with the set of teeth disposed on the inner side on the driven pinion, with the set of teeth disposed on the outer side engaging with a pinion driving the rotor portion.

24. The reflector antenna according to claim 23, wherein the toothed belt having the sets of teeth on each side is deflected on a pinion supported on the drive wheel.

25. The reflector antenna according to claim 24, wherein the toothed belt having the sets of teeth on each side is tensioned by a belt tightener that is supported on the drive wheel.

26. The reflector antenna according to claim 15, wherein the stator portion and the rotor portion each include a section formed as a hollow cylinder, with the teeth being disposed on an outer surface of the respective hollow cylinder and a center segment supported on an inner surface of the respective hollow cylinder.

27. The reflector antenna according to claim 26, wherein the drive wheel is supported for rotation relative to the respective hollow cylinder.

28. The reflector antenna according to claim 27, wherein the teeth are disposed on a portion of the respective hollow cylinders facing the drive wheel and the respective portions of the hollow cylinders face one another relative to the drive wheel.

29. The reflector antenna according to claim 26, wherein the respective hollow cylinders are identical to one another.

30. The reflector antenna according to claim 26, and further comprising an aligning antenna that can be connected to the hollow cylinder of the rotor portion.

31. The reflector antenna according to claim 14, wherein the drive means include a motor and at least one toothed belt driven by the motor.

32. The reflector antenna according to claim 31, wherein the toothed belt meshes with teeth disposed on the drive wheel and also with teeth disposed on the rotor portion.

33. The reflector antenna according to claim 32, wherein the toothed belt engages with the teeth of the rotor portion and—after a turn—with the teeth of the drive wheel.

34. The reflector antenna according to claim 31, wherein the drive means include two toothed belts, with a first toothed belt engaging with the rotor portion and the second toothed belt engaging with the drive wheel.

35. The reflector antenna according to claim 34, wherein one of the two toothed belts has teeth formed on an outside surface, whereas the other toothed belt has teeth formed on an inside surface.

36. The reflector antenna according to claim 34, wherein the two toothed belts have a common deflection roller.

37. The reflector antenna according to claim 36, wherein the deflection roller has pinions associated with the drive wheel and the rotor and having an identical number of teeth.

38. The reflector antenna according to claim 2, wherein the rotor portion includes a first motor that drives the rotor portion relative to the drive wheel, and wherein the drive wheel is in addition driven by a second motor disposed on the stator portion.

39. The reflector antenna according to claim 38, wherein the first motor is controlled with an angular ratio of 2:1 relative to the second motor.

40. The reflector antenna according to claim 38, wherein the first and second motors include gears to couple the first and second motors to the rotor portion and the drive wheel, respectively.

41. The reflector antenna according to claim 38, wherein the first and second motors include toothed gears to couple the first and second motors to the rotor portion and the drive wheel, respectively.

42. The reflector antenna according to claim 38, wherein the first and second motors include toothed belts to couple the first and second motors to the rotor portion and the drive wheel, respectively.

43. The reflector antenna according to claim 38, wherein one of the first and second motors is coupled by a toothed belt and the other motor is coupled by a toothed gear to the rotor portion and the drive wheel, respectively.

44. The reflector antenna according to claim 43, wherein the rotor portion is driven by gear wheels and the drive wheel is driven via a toothed belt.

45. The reflector antenna according to claim 43, wherein the rotor portion is driven by a toothed belt and the drive wheel is driven by gear wheels.

46. The reflector antenna according to claim 38, and further including a controller with a comparator circuit and a third motor that controls antenna movements in a vertical plane, wherein the first, second and third motors are controlled by the controller and wherein movement of the antenna about the vertical and horizontal axis is controlled by control signals produced by the comparator circuit.

47. The reflector antenna according to claim 46, wherein the control signals are produced by detecting a deviation from a largest possible signal received by the reflector antenna.

48. The reflector antenna according to claim 47, wherein the control signals are produced in the event that a ship deviates from a predetermined course.

49. The reflector antenna according to claim 46, wherein the control signals for controlling the third motor that controls antenna movements in the vertical plane, are produced by a pulse generator that detects movements of a ship.

50. The reflector antenna according to claim 49, wherein the pulse generator responds to a signal received from a compass.

51. The reflector antenna according to claim 1, and further comprising a guide tube disposed between the rotatable segment and the rotor portion, wherein the connecting cable includes a section adjacent to the rotatable segment and passing through the guide tube.

52. The reflector antenna according to claim 1, and further including a flexible spiral surrounding the connecting cable and rotating motion together with the connecting cable.

* * * * *